United States Patent [19]

Yampolsky

[11] 4,305,460

[45] Dec. 15, 1981

[54] HEAT TRANSFER TUBE

[75] Inventor: Jack S. Yampolsky, San Diego, Calif.

[73] Assignee: General Atomic Company, San Diego, Calif.

[21] Appl. No.: 168,577

[22] Filed: Jul. 14, 1980

Related U.S. Application Data

[63] Continuation-in-part of Ser. No. 15,863, Feb. 27, 1979, abandoned, which is a continuation-in-part of Ser. No. 750,581, Dec. 15, 1976, abandoned.

[51] Int. Cl.[3] ..... F28F 1/08; F28F 1/06

[52] U.S. Cl. ..... 165/179; 138/38; 138/154; 138/173; 228/145

[58] Field of Search ..... 138/38, 173, 122; 165/179, 184, 177; 228/17.7, 145

[56] References Cited

U.S. PATENT DOCUMENTS

| | | | |
|---|---|---|---|
| 1,394,311 | 10/1921 | Lang | 165/177 |
| 2,252,045 | 8/1941 | Spanner | 138/38 |
| 2,874,683 | 2/1959 | La Rue | 165/177 |
| 3,345,590 | 10/1967 | Wolfgang et al. | 138/173 |
| 3,358,112 | 12/1967 | Timmers | 138/38 |
| 3,578,075 | 5/1971 | Winter | 165/179 |
| 3,601,570 | 8/1971 | Davis | 228/17.7 |
| 3,612,175 | 10/1971 | Ford et al. | 165/179 |
| 3,762,468 | 10/1973 | Newson et al. | 165/177 |
| 3,779,312 | 12/1973 | Withers, Jr. et al. | 165/184 |
| 3,826,304 | 7/1974 | Withers, Jr. et al. | 165/179 |

FOREIGN PATENT DOCUMENTS

| | | | |
|---|---|---|---|
| 214265 | 8/1956 | Australia | 138/122 |
| 2009762 | 2/1970 | France | 165/184 |
| 569000 | 4/1945 | United Kingdom | 165/177 |
| 684830 | 12/1952 | United Kingdom | 165/177 |
| 612142 | 6/1978 | U.S.S.R. | 165/179 |

OTHER PUBLICATIONS

Ciftci, Huseyin, An Experimental Study of Filmwise Condensation on Horizontal Enhanced Condenser Tubing, Dec. 1979, Thesis, Naval Postgraduate School, Monterey, Calif.

Reilly, David J., An Experimental Investigation of Enhanced Heat Transfer on Horizontal Condenser Tubes, Mar. 1978, Thesis, Naval Postgraduate School, Monterey, Calif.

Newson et al., The Development of Enhanced Heat Transfer Condenser Tubing, AERE R-7318, UKAEA Research Group, atomic energy Research Establishment, Harwell, Jul. 1973.

*Primary Examiner*—Sheldon J. Richter

*Attorney, Agent, or Firm*—Fitch, Even, Tabin, Flannery & Welsh

[57] ABSTRACT

A spirally fluted metallic heat transfer tube is disclosed wherein the finished tube has improved heat transfer performance through the provision of a predetermined number range of multiple start continuous helical flutes formed along its longitudinal length, the flutes having specific helix angle relation and flute height to tube hydraulic diameter ratio so as to establish a ratio of thermal diffusivity to momentum diffusivity greater than 1.

6 Claims, 6 Drawing Figures

HEAT TRANSFER TUBE

This application is a continuation-in-part from copending application, Ser. No. 15,863, filed Feb. 27, 1979, now abandoned, which is a continuation-in-part from application, Ser. No. 750,581, filed Dec. 15, 1976, now abandoned.

The present invention relates generally to heat transfer tubes for heat exchangers, and more particularly to a heat transfer tube having its annual wall formed to define multiple start continuous longitudinally extending flutes of specific profile and flute height which provide an improved heat transfer coefficient over a smooth non-fluted tube without an increase in friction coefficient.

BACKGROUND OF THE INVENTION

The transfer of heat in tubular heat exchangers is an operation that has widespread application in all industries, particularly in the process and power industries. As energy and capital costs have increased, the need for improving the efficiency of heat transfer surfaces has taken on greater importance. Because the cost of heat exchangers employing heat transfer tubes depends in substantial part upon the number of tubes used in the heat exchangers, it is highly desirable that the amount of tubing required to provide a given heat transfer be reduced. Furthermore, since the temperature of the tube wall is determined by the surface heat transfer coefficients on the inside and outside surfaces of the tube wall for given stream conditions, preferential control over one or both of these coefficients results in some measure of control of the tube wall temperature. This control can be employed to either increase or decrease the temperature of one of the process streams, i.e. either internal flow through the tubes or external flow over the outer surfaces of the tubes, for a given tube wall temperature, or to reduce the tube wall temperature for a particular process stream temperatures.

Heat exchangers frequently involve change of phase, e.g., water is sufficiently heated so as to be transformed to steam and steam is sufficiently cooled to become water. Augmented heat transfer is frequently desired in these applications; e.g., in steam condensers the internal thermal resistance of the single phase coolant can be three times as high as the external resistance. A similar need for augmented heat transfer arises in the boilers of steam bottoming cycles; in these units heat is supplied from the exhaust gases of a diesel engine or gas turbine, involves a low heating rate and thus requires a large heat transfer area unless the heat transfer can be augmented. In both boiling and condensing applications heat transfer is generally limited by the transfer characteristics of the single phase fluid. If this limitation is removed by suitable augmentation, the performance of a heat exchanger or condenser is then determined by two phase heat transfer characteristics.

The use of swirl to augment heat transfer is well known and may be established in a variety of ways. For example, twisted-tape inserts have been employed which provide means for increasing the heat transfer within the interior of tubing. Tangential injection of the fluid at the entrance to a tube has also been employed to provide an initial rotation which decays in the downstream direction but provides augmented heat transfer while it prevails.

The general objective of improvement to heat exchange tubing is the increase of the heat transfer relative to the frictional flow loss. For single phase flow on either side of a tube this is expressed by the Colburn factor.

$$2_j/f = 2\ N_s P_r^{\frac{2}{3}}/f$$

Where:

$N_s$=Stanton Number $P_r$=Prandtl Number f=Fanning friction factor

The Colburn factor is numerically equal to 1 for a smooth tube. Therefore, a tube performance factor can be defined as the ratio of the Colburn factor of an enhanced tube relative to a smooth tube.

$$\zeta = \frac{\frac{j}{f}\ \text{enhanced}}{\frac{j}{f}\ \text{smooth}}$$

This performance factor can be related to the ratio of the turbulent exchange coefficients of heat relative to momentum, (the reciprocal of the turbulent Prandtl Number).

$$\zeta = \epsilon_h/\epsilon_m = 1/\tau_t$$

Where:

$\epsilon_h$=turbulent exchange coefficient for heat $\epsilon_m$=Turbulent exchange coefficient for momemtum $\tau_t = \epsilon_m/\epsilon_h$ The present state of the art of enhanced tubing for heat exchangers has an upper bound of 1 for the tube performance factor (or ratio of turbulent diffusivity of heat to that of momentum) which is the value for a smooth tube.

One attempt to provide improved heat-transfer coefficient is disclosed in U.S. Pat. No. 3,612,175 which shows an improvement in overall heat transfer coefficient by a factor of approximately 1.6 at a cost of increased pressure drop by a factor of 3.5 as compared to the heat transfer and pressure drop of a smooth tube. The ratio of increase in heat transfer is less than the increase in pressure drop relative to a smooth tube. Pat. No. 3,612,175 recognizes that it is highly desirable to provide for improved condenser tubing in which the heat transfer is maximized but the increase in the pressure drop kept as low as possible.

It can be established by mathematical analysis that the index for heat transfer per unit pumping power for a tube having a spirally fluted wall, which tube may thereby be defined as being enhanced and extended, relative to a smooth round tube is:

For fixed heat transfer;

$$\frac{\left(\frac{Q}{W}\right)_e}{\left(\frac{Q}{W}\right)_s} = \frac{(PL)^2}{(\pi dL)^2 s}\ \frac{\left(\frac{N_s^3}{\lambda}\right)_e}{\left(\frac{N_s^3}{\lambda}\right)_s}$$

Where:

Q is the rate of heat transfer

P is the perimeter of the enhanced and extended tube $N_s$ is the Stanton Number $h/C_p\rho u$ W is the pumping power λ is the friction coefficient
$C_p$ is the specific heat at constant pressure
u is the mean velocity
h is the surface conductance coefficient
ρ is the density of the fluid
For fixed coolant flow rate;

$$\frac{\left(\frac{Q}{W}\right)_e}{\left(\frac{Q}{W}\right)_s} = \frac{\left(\frac{Ns}{\lambda}\right)_e}{\left(\frac{Ns}{\lambda}\right)_s}$$

It can also be established that the ratio of Stanton Number and friction factor or coefficient relates to the ratio of the turbulent exchange coefficients of heat and momentum as $E_h/E_m = N_s/\lambda$. From this it follows that an increase in the ratio of Stanton Number to friction coefficient, or alternatively, the ratio of turbulent exchange coefficient for heat to that of momentum, greater than that of a round smooth tube (that has a value of one) is highly desirable, particularly if the heat transfer area is increased as well. However, there can be an advantage when the frictional increase is greater than the Stanton Number increase if the frictional increase is less than the product of the cube of the Stanton Number increase and the heat transfer area increase for the case of a given rate of heat transfer.

It is generally recognized that in heat transfer tubes most of the resistance to heat transfer and most of the skin friction is associated with the fluid adjacent the wall of the tube, the so-called laminar sublayer where the transport of heat and momentum are dependent on the molecular transport; the thermal conductivity and the viscosity. Increasing the transport of heat can only be achieved in a straight round tube by increasing the shear through an increase of fluid velocity in the tube or increasing the level of turbulence by roughening the surface of the round tube. Either of these methods are bounded in their performance by the value of $E_h/E_m = 1$. However, the creation of an instability in the vicinity of the laminar boundary sublayer can result in a greater increase in the turbulent exchange coefficient of heat relative to the turbulent exchange coefficient of momentum.

BRIEF SUMMARY OF THE INVENTION

One of the primary objects of the present invention is to provide a heat transfer tube which results in improved overall heat transfer coefficient without an increase in the frictional coefficient or pressure drop internally of the tube over smooth unfluted tubes.

A more particular object of the present invention lies in the provision of a heat transfer tube having a predetermined range of multiple start helical flutes formed in the tube wall, the flutes having flute height to hydraulic diameter ratio lying in a predetermined range and having a helix angle relation to the longitudinal axis of the tube within a predetermined range so that the flutes continuously induce rotation of the flow both within and exterior of the heat transfer tube, the specific parameters of the flutes being such as to improve the overall heat transfer coefficient without increasing the pressure drop through the tube over a smooth tube.

A further particular object of the present invention is to provide a spirally fluted heat transfer tube wherein the multiple start flutes have a predetermined flute height to hydraulic diameter ratio and have a predetermined number of flutes and flute helix angle range relative to the axis of the tube so as to establish a ratio of thermal diffusivity to momentum diffusivity ($E_h/E_m$) greater than 1.

The various objects and advantages of the present invention will become apparent from the following detailed description of the invention when taken in conjunction with the accompanying drawings wherein like reference numerals designate like elements throughout the several views, and wherein.

Figure 1:
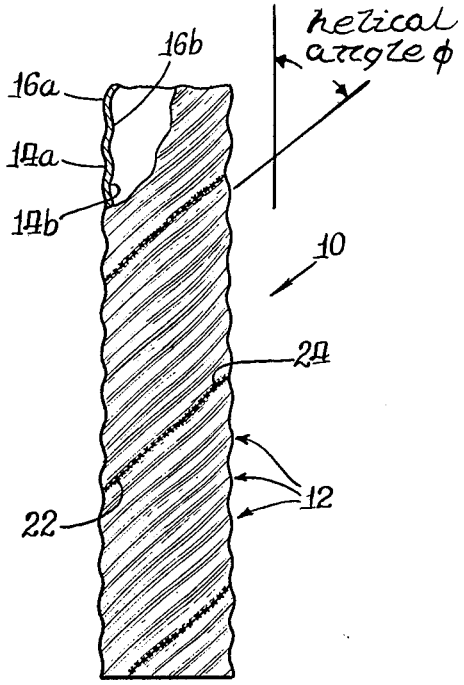
FIG. 1 is a partial elevational view of a heat transfer tube in accordance with the present invention.
Figure 2A:
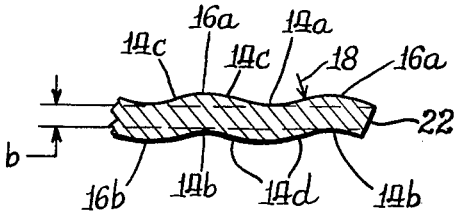
FIG. 2 is a perspective view of a portion of a strip of metallic material formed with a plurality of longitudinal flutes and which may be formed into a heat transfer tube as shown in FIG. 1.
Figure 2:
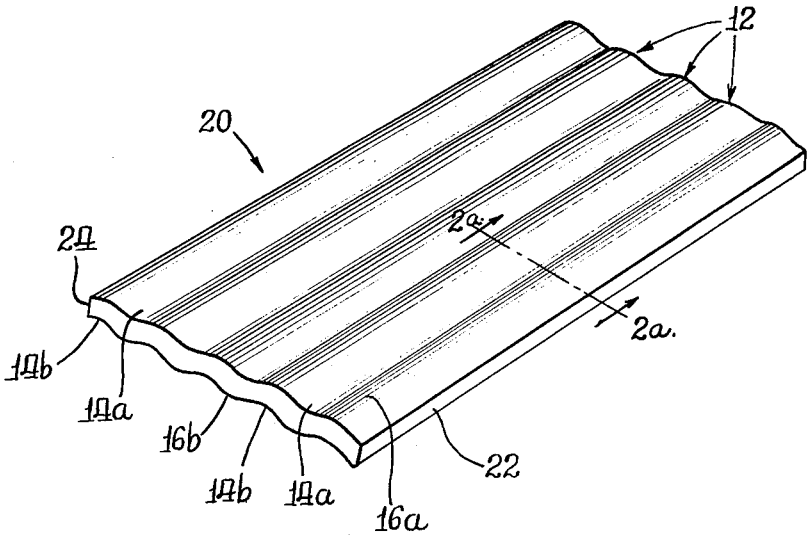
Figure 3:
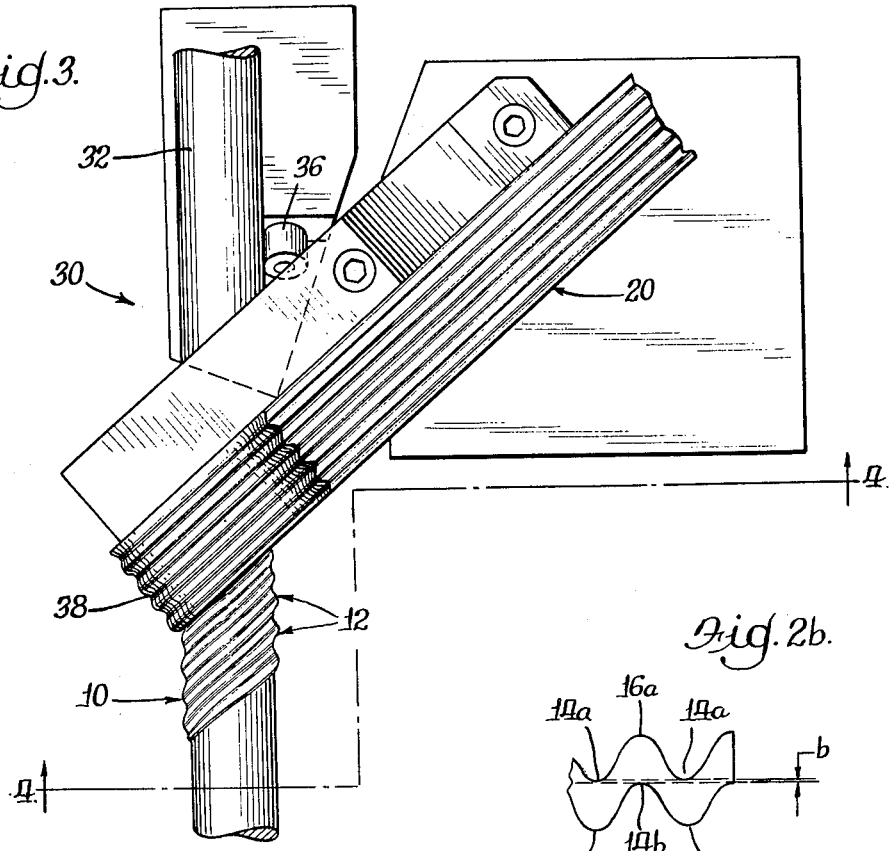
Figure 2B:
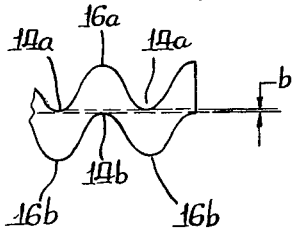
Figure 4:
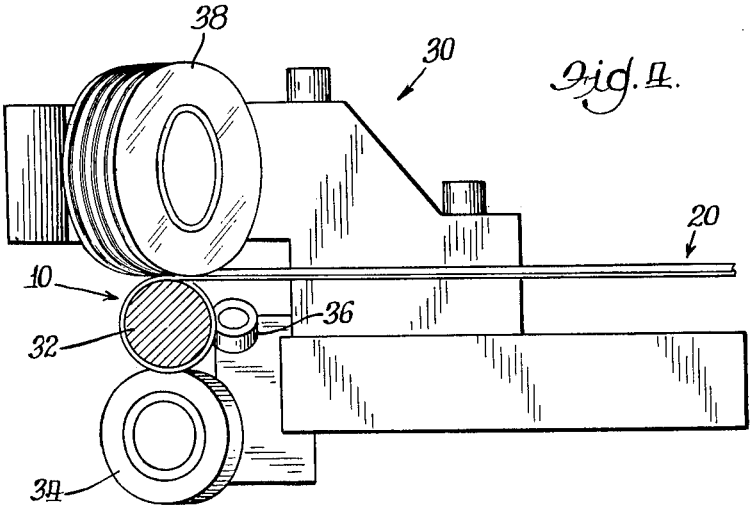

FIG. 2*a* is a partial transverse sectional view taken along the line 2*a*—2*a* of FIG. 2;

FIG. 2*b* is a partial transverse sectional view similar to FIG. 2*a* but showing an alternative flute profile or contour;

FIG. 3 is a partial plan view schematically illustrating one example of apparatus for forming the fluted strip of FIG. 2 into a spiral wound tube to form the heat transfer tube of FIG. 1; and FIG. 4 is a schematic end view of the tube forming apparatus of FIG. 3.

Referring now to the drawings, and in particular to FIG. 1, a heat transfer tube in accordance with the present invention is indicated generally at 10. The heat transfer tube 10 has a circumferential wall which defines a plurality of helical flutes, indicated generally at 12, which may be termed multiple start flutes. The flutes 12 form alternating crests and valleys as indicated at 14*a* and 16*a*, respectively, when considered externally of the tube 10, and indicated at 14*b* and 16*b* when considered internally of the tube 10. To maintain maximum mean wall thickness of the tube wall, the valleys of one surface, such as the outer surface, are preferably opposite the crests of the other surface, i.e. the inner surface, and vice versa.

With reference to FIG. 2, the illustrated heat transfer tube 10 is made from an initially flat strip or sheet of suitable metallic heat transfer material such as steel, aluminum, or the like, indicated generally at 20, which has substantially uniform thickness and substantially greater longitudinal length than transverse width. The flat metallic strip 20 may, for example, be drawn from a roll and passed through conventional straightener rolls after which the opposite surfaces of the strip are formed by known means, such as opposed contour rollers (not shown) between which the strip is passed, to establish a plurality of longitudinally extending parallel flutes 12 in the opposite surfaces. Other methods of manufacture, such as extrusion means, may also be employed to form the flutes 12. The flutes 12 extend across the full transverse width of the strip and subsequently form the helical flutes 12 on the heat transfer tube 10.

The flute contour or transverse profile prior to spiralling, such as shown in FIGS. 2, 2*a* and 2*b*, preferably approaches a mathematically smooth curve such as a surface that can be defined by a transcendental function. The opposite surfaces of the portion of the metallic strip illustrated in FIG. 2*a* are extended to define sine wave profiles. The flute contours illustrated in FIG. 2*b* are formed so as to define a circular arc at the crest of each flute, such as indicated at 14*a* and 14*b* for the inner and outer fluted surfaces, respectively, and to define a circular arc at each valley, such as indicated at 16*a* and 16*b*, respectively, for the inner and outer surfaces. The circular arcs defining the crests and valleys are joined by straight lines tangent to both corresponding circular arcs. Alternatively, the circular arcs defining the crests and valleys may blend with each other so as to be described by a transcendental function. The shape of the flutes should taper with the tip or crest narrower by a factor of between approximately 3 and 6 than the base of the flute as defined by the distance between parallel planes normal to the tube axis and intersecting the centers of curvature of the base or valley arcs. Stated alternatively, the base of each flute, considered in longitudinal section through the tube, should be greater by a factor of between approximately 3 and 6 than the width of the corresponding crest. By "inner" and "outer" surfaces are meant the inner and outer surfaces of a resulting heat transfer tube 10 formed from a sheet having longitudinal flutes formed therein with transverse contours as illustrated in FIGS. 2, 2*a* or 2*b*.

In the embodiments illustrated in FIGS. 2*a* and 2*b* the innermost surface elements defining the crests in the opposite fluted surfaces in the strip 20, such as 14*a* and 14*b*, are separated by a thickness of base material, such thickness being indicated at "b" in FIG. 2*a*. The thickness of base material is uniform about the circumference of the formed tube 10. By separating the crests 14*a* and 14*b* in the opposite surfaces of the strip 20 by a thickness of base material, the tube made from the fluted strip retains an ability to resist pressures, both internal and external, without imposing large bending loads on the tube walls, such as 14*c* and 14*d* in FIG. 2*a*, defining the flutes which would tend to deform the tube wall. An example of a bending load acting on a wall 14*c* is indicated by the force vector 18 in FIG. 2*a*.

While the planes containing the innermost surface elements of the crests 14*a* and 14*b* in the opposite surfaces of the fluted strip 20 are preferably spaced as shown in FIG. 2*a*, satisfactory performance may, depending on the particular application, be achieved when such planes are substantially coplanar such as shown in FIG. 2*b*. As illustrated in FIG. 2*b*, the dimension "b" may be negative for low or moderate pressures; that is, the crest, 14*b*, of the flutes on the inner surace of a tube may lie on a diameter greater than the diameter on which the crests, 14*a*, of the outer surface lie.

While the heat transfer tube 10 may be made of any suitable metallic heat transfer material, examples include 12% chrome alloy steel, such as Type 420 or 422 stainless steel, or Type 300 series stainless steel, Titaniun, and aluminum. The metallic strip 20 may have a thickness of approximately 0.015 to 0.120 inch for subsequent forming into a tube having a diameter of approximately $\frac{3}{4}$ to 1 inch.

While the fluted metallic strip 20 may be formed into the heat transfer tube 10 by different methods, the strip is preferably formed by helically winding the strip about an axis into a helically wound tubular configuration with the lateral edges of the strip, as indicated at 22 and 24 in FIG. 2, in abutting relationship whereafter the abutting lateral edges are secured in fluid-tight relation. FIGS. 3 and 4 schematically illustrate one type of apparatus, indicated generally at 30, which may be employed to form the longitudinally fluted metallic strip 20 helically or spirally about an axis to form the heat transfer tube 10. The apparatus 30 employs a cylindrical mandrel 32 having three rotatable rollers positioned thereabout. The rollers include a first roller 34 comprising a bottom support roller, a second smaller diameter side support roller 36 and a third forming roller 38 of larger diameter than the rollers 34 and 36 and being disposed to overlie the mandrel 32 on the opposite side thereof from the bottom support roller 34. The bottom support roller 34 and side support roller 36 have generally cylindrical peripheral surfaces and serve to engage the peripheral surface of the mandrel 32 and maintain it in supported relation adjacent the forming roller 38. The forming roller 38 has a peripheral surface having a surface profile corresponding to the surface configuration of the flutes 12 of the metallic strip 20 so as to conform to the surface of the fluted metallic strip during helical forming of the strip into the heat transfer tube 10. For example, the mandrel 32 may be provided with the opposing surface of the fluted strip 20 when forming the strip into the tube 10. The support rollers 34 and 36 and the forming roller 38 are supported for rotation about axes which are angularly disposed relative to the axis of the cylindrical mandrel 32, as is known.

In the operation of the apparatus 30, a strip of suitable metallic sheet or strip is formed so as to define longitudinal flutes by contour rolling so as to form a fluted strip as illustrated in FIG. 2. The fluted strip or sheet is then fed between the forming roller 38 and the mandrel 32 tangent to the peripheral surfaces of the mandrel 32 and forming roller 38 in a direction perpendicular to a vertical plane containing the axis of rotation of the forming roller 38. The forming apparatus 30 is operative to form the strip 20 into a helical wound tubular configuration with the lateral edges 22 and 24 in abutting relation. Thereafter, the abutting lateral edges of the helically wound strip 20 are secured together in fluid-tight relation by any known welding technique including electron beam or laser beam welding. The surface extensions or flutes 12 which were originally longitudinal on the strip 20 before the spiral forming now form a continuous spiral or helical fluted surface on both the inside and outside of the tube 10.

In accordance with the present invention, the metallic strip 20 is formed into the heat transfer tube 10 so as to define a spiral or helix flute angle in the range of between approximately 25 and 50 degrees, the spiral or helix angle being the included angle between the longitudinal axis of the tube and a plane tangent to a point on the line of abutting lateral edges of the spirally wound strip and normal to the axis of the tube. In FIG. 1, the flute helix angle is indicated by the Greek alphabet symbol for phi.

A comparison of the performance of spirally fluted heat transfer tubes made in accordance with the present invention with the performance of prior commercially available spirally fluted and straight tubes may be made by establishing, for each tube, a tube performance factor containing the ratio of Stanton Number divided by the friction factor and multiplied by the Prandtl Number to the $\frac{2}{3}$ power. The performance factor may then be plotted as the ordinate against Reynold's Number as the absissa. The Prandtl Number factor is necessary to account for differences in the properties of the coolant that are assumed constant in the aforementioned mathematical derivation. As a Reynold's Number less than 60,000 and for constant mass flow, a spirally fluted tube constructed in accordance with the present invention resulted in a performance factor significantly greater than 1. At a Reynold's number of 30,000 a performance factor of 2 was obtained for a spirally fluted tube constructed in accordance with the present invention and having a flute spiral angle of approximately 30°, while a performance factor of 1.37 resulted with a 45° spirally fluted tube.

In an evaluation of heat transfer tubes based on constant heat transfer, it was also found that spirally fluted tubes in accordance with the present invention resulted in a performance factor greater by approximately a factor of two than the performance factors of prior commercially available tubes.

As aforementioned, it is generally recognized that most of the resistance to heat transfer and most of the skin friction in a heat transfer tube is associated with the fluid adjacent the wall of the tube, the so-called laminar sublayer where the transport of heat and momentum are dependent on the molecular transport; the thermal conductivity and the viscosity. For a straight or plain round tube, increasing the transport of heat can only be achieved by increasing the shear through an increase of fluid velocity in the tube or increasing the level of turbulence by roughening the surface of the round tube. Either of these methods are bounded in their performance by the value of $E_h/E_m=1$.

In accordance with an important feature of the heat transfer tube 10 of the present invention, an instability in the vicinity of the laminar boundary sublayer is created by the helical flutes which results in an increase in the diffusivity of heat relative to the increase in the diffusivity of momentum. As noted, the spiral or helix angle of the multiple start flutes 12 should be in the range of between approximately 25° an 50° relative to the longitudinal axis of the tube. The exact value of the angle will depend on the value of the thermal flux. The height of the flutes relative to the hydraulic diameter of the tube should be greater than the relative thickness of the laminar sublayer at a Reynold's Number of 30,000, where "hydraulic diameter" is defined as $$D_h = \frac{4 \times \text{cross sectional area}}{\text{wetted diameter}}.$$

The cross sectional area is taken in a plane transverse to the axis of the tube, while the wetted perimeter is the full perimeter of the inside surface of the tube in this same transverse plane. The ratio of flute height to hydraulic diameter of the tube should be greater than 0.025, and preferably in the range of approximately 0.050 to 0.250. The physical parameters that determine the exact value of flute height to hydraulic diameter are the heat flux and the angle of the spiral, both increasing with the flute height to tube diameter ratio.

The number of flutes for a given tube is a combination of $Nx \tan \phi/D_h > 20$, where Nx represents the number of flutes, $\phi$ represents the flute helix angle, and $D_h$ is the hydraulic diameter. For the tube 10 in accordance with the present invention, the number of flutes 12 is preferably selected from the range of approximately 20–40, the lower number of flutes being selected for tubes having flute helix angles in the upper end of the aforedescribed range 25°–50°, while a greater number of flutes is selected for flute helix angles in the lower end of the range 25°–50°. As aforementioned, the contour of flutes 12 prior to spiralling (i.e. as shown in FIG. 2) should approach a mathematically smooth curve, such as would result from a circular arc at the crest and valley joined by a line tangent to both circular arcs or alternately a surface whose cross section can be described by a transcendental function, such as a sine wave.

The heat transfer tube 10 in accordance with the present invention shows an improvement in overall heat transfer coefficient over prior heat transfer tubes without any increase in frictional coefficient (pressure drop). For example, the aforementioned Pat. No. 3,612,175 shows an improvement in overall heat transfer coefficient by a factor of approximately 1.6 at a cost of increased pressure drop by a factor of 3.5 as compared to the heat transfer and pressure drop of a smooth tube. The ratio of increase in heat transfer is less than the increase in pressure drop relative to a smooth tube. Pat. No. 3,612,175 recognizes that it is highly desirable to provide for improved condenser tubing in which the heat transfer is maximized but the increase in the pressure drop kept as low as possible. The heat transfer tube 10 in accordance with the present invention shows an equivalent improvement in overall heat transfer coefficient but without any increase in frictional coefficient (pressure drop). Measurements made by HTRI (Heat Transfer Research Inc.) on a 30° spiral fluted tube showed an overall heat transfer coefficient of 1164 Btu/hr $ft^2F$ and a coefficient of friction of 0.00466 at a water velocity of 5.76 ft/sec. This friction coefficient would result in a pressure drop of 0.63 ft. of water in a tubing length of 42 inches (assuming all of the tubing is spiralled). Therefore, the heat transfer is increased without a pressure drop penalty over a smooth tube. This is significant performance improvement over the heat transfer tube of Pat. No. 3,612,175. The helix angle in the flutes in tube 10 is measured from the flow axis, while the angle in Pat. No. 3,612,175 is measured from a plane normal to the tube axis.

It is recognized that the axial pressure gradient along the tube causes a flow through the tube and in the flutes. The helical angle of the flutes induces rotation of the flow within the flutes and of the bulk flow as a result of the curvature of the flutes. The core flow is primarily in solid body rotation, has no strain, and is stable. In the region between the core flow and the flute flow, there is an interchange of angular momentum from the individual flutes to the core flow, resulting in a decrease of the angular momentum in the flutes. This is the case of instability, since the decrease of the peripheral velocity is destabilizing. The instability increases with radially inward heat flow through the wall and decreases with the direction of heat flow outward. Instability enhances the turbulent exchange near the wall, leading to improved heat transfer since most of the resistance to heat flow is in the laminar sublayer. The rotation of the core flow reduces the axial momentum loss, so the friction coefficient does not increase with the increased heat transfer coefficient.

Various features of the invention are defined in the following claims.

What is claimed is:

1. A heat transfer tube for effecting heat transfer between the tube wall and a fluid flowing through said tube, comprising a substantially straight axis metallic tube having a plurality of multiple start spiral flutes of substantially uniform configuration formed along the length of the tube wall, said flutes each forming a helix angle of between approximately 25 to 50 degrees relative to the axis of the tube, each of said flutes having a flute height sufficient to establish a flute height to tube hydraulic diameter ratio greater than approximately 0.025, and wherein the number of said multiple start flutes is selected by the combination of $Nx \tan \phi/D_h > 20$ where;

Nx = the number of flutes, $\phi$ = the helix angle of the flutes, and $D_h$ = the hydraulic diameter of the tube

2. A heat transfer tube as defined in claim 1 wherein said flute height to tube hydraulic diameter ratio is between 0.050 and 0.250.

3. A heat transfer tube as defined in claim 1 wherein said tube is made from a flat sheet of metallic material which is spiralled to establish abutting edges secured in fluid-tight relation, said flat sheet being formed to define a plurality of parallel longitudinal flutes prior to spiralling so that each flute has a transverse profile defined by a circular arc at the crest and valley joined by a line tangent to both circular arcs.

4. A heat transfer tube as defined in claim 1 wherein said tube is made from a flat sheet of metallic material which is spiralled to establish abutting edges secured in fluid-tight relation, said flat sheet being formed to define a plurality of parallel longitudinal flutes prior to spiralling so that the flutes define a transverse profile described by a transcendental function.

5. A heat transfer tube as defined in claim 1 wherein the number of multiple start flutes is selected from the range 20–40.

6. A heat transfer tube as defined in claims 5 or 3 wherein each of said flutes has a profile, considered in a plane containing the longitudinal axis of the tube, which tapers outwardly from a base and defines a tip at the apex of the flute, said base having a width equal to between approximately 3 to 6 times the width of the corresponding tip.

* * * * *

UNITED STATES PATENT AND TRADEMARK OFFICE

CERTIFICATE OF CORRECTION

PATENT NO. : 4,305,460

DATED : December 15, 1981

INVENTOR(S) : Jack S. Yampolski

It is certified that error appears in the above—identified patent and that said Letters Patent is hereby corrected as shown below:

Column 10, line 9, "3" should be --2--.

Signed and Sealed this

*Twenty-ninth* Day of *June 1982*

[SEAL]

*Attest:*

GERALD J. MOSSINGHOFF

*Attesting Officer*

*Commissioner of Patents and Trademarks*